US008534294B2

(12) United States Patent
Yang et al.

(10) Patent No.: US 8,534,294 B2
(45) Date of Patent: Sep. 17, 2013

(54) METHOD FOR MANUFACTURE OF SMOKING ARTICLE FILTER ASSEMBLY INCLUDING ELECTROSTATICALLY CHARGED FIBER

(75) Inventors: Szu-Sung Yang, Midlothian, VA (US); Lixin L. Xue, Midlothian, VA (US); Jing C. Chang, Springfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 846 days.

(21) Appl. No.: 12/576,948

(22) Filed: Oct. 9, 2009

(65) Prior Publication Data

US 2011/0083686 A1 Apr. 14, 2011

(51) Int. Cl.
*A24C 1/32* (2006.01)
*B31C 99/00* (2009.01)

(52) U.S. Cl.
USPC ..... 131/29; 131/280; 493/39; 493/50; 493/47; 493/45

(58) Field of Classification Search
USPC ..... 131/29, 280; 493/39, 30, 47, 45
See application file for complete search history.

(56) References Cited

U.S. PATENT DOCUMENTS

| | | | | |
|---|---|---|---|---|
| 2,479,930 | A | 8/1949 | Herkenhoff et al. | |
| 2,805,671 | A * | 9/1957 | Hackney et al. | 131/333 |
| 2,916,038 | A | 12/1959 | Wade | |
| 3,111,702 | A | 11/1963 | Berger et al. | |
| 3,313,306 | A | 4/1967 | Berger et al. | |
| 3,339,560 | A | 9/1967 | Kiefer et al. | |
| 3,575,179 | A | 4/1971 | Troll et al. | |
| 3,648,711 | A | 3/1972 | Berger et al. | |
| 3,656,484 | A | 4/1972 | Roberts et al. | |
| 3,757,803 | A | 9/1973 | Chiang | |
| 3,809,097 | A | 5/1974 | Clayton et al. | |

(Continued)

FOREIGN PATENT DOCUMENTS

| | | |
|---|---|---|
| DE | 1 084 626 | 6/1960 |
| DE | 1243072 B | 6/1967 |

(Continued)

OTHER PUBLICATIONS

Invitation to Pay Additional Fees and Partial International Search Report mailed Mar. 24, 2011 for International Application No. PCT/EP2010/006107.

(Continued)

*Primary Examiner* — Richard Crispino
*Assistant Examiner* — Dionne Walls Mayes
(74) *Attorney, Agent, or Firm* — Buchanan Ingersoll & Rooney PC

(57) ABSTRACT

Provided are a method and apparatus for making a cigarette filter assembly for potentially reducing particle breakthrough. The method includes forming a lofty porous network of charge retaining polymer fibers by mechanical, chemical or thermal bonding of the fibers, wrapping the lofty porous network in a cylindrical or tubular shape with optional mediating filter fibers in a filter paper to form a filter plug while maintaining the lofty structure. The charge retaining fibers can be charged to attract and hold particles from such sources as particulate matter from sorbents (preventing breakthrough), and smoke constituents while having a suitable pressure drop. The apparatus handles the lofty media with minimal crushing, for example, by spacing apart delivery rolls equipped with protrusions to punch, push, and/or pull the lofty media ahead for high speed operation.

16 Claims, 10 Drawing Sheets

(56) References Cited

U.S. PATENT DOCUMENTS

| | | | | |
|---|---|---|---|---|
| 3,826,177 | A | 7/1974 | Berger et al. | |
| 3,882,877 | A | 5/1975 | Brackmann et al. | |
| 4,032,688 | A | 6/1977 | Pall | |
| 4,059,121 | A | 11/1977 | Brackmann et al. | |
| 4,174,720 | A | 11/1979 | Hall | |
| 4,197,863 | A | 4/1980 | Clayton et al. | |
| 4,215,682 | A | 8/1980 | Kubik et al. | |
| 4,258,730 | A | 3/1981 | Tsukamoto | |
| 4,260,523 | A | 4/1981 | Tsukamoto | |
| 4,390,031 | A | 6/1983 | Berger | |
| 4,486,365 | A | 12/1984 | Kliemann et al. | |
| 4,507,107 | A | 3/1985 | Berger | |
| 4,528,050 | A | 7/1985 | Arther et al. | |
| 4,540,625 | A | 9/1985 | Sherwood | |
| RE32,171 | E | 6/1986 | Van Turnhout | |
| 4,592,815 | A | 6/1986 | Nakao | |
| 4,593,706 | A | 6/1986 | Preston et al. | |
| 4,930,526 | A | 6/1990 | Chen et al. | |
| 5,044,381 | A | 9/1991 | Thomas | |
| 5,143,098 | A | 9/1992 | Rogers et al. | |
| 5,191,905 | A | 3/1993 | Tsukamoto | |
| 5,271,419 | A | 12/1993 | Arzonico et al. | |
| 5,296,061 | A | 3/1994 | Ando et al. | |
| 5,322,075 | A | 6/1994 | Deevi et al. | |
| 5,350,443 | A | 9/1994 | von Blucher et al. | |
| 5,429,848 | A | 7/1995 | Ando et al. | |
| 5,465,739 | A | 11/1995 | Perfetti et al. | |
| 5,468,529 | A | 11/1995 | Kwon et al. | |
| 5,497,793 | A | 3/1996 | Kubica | |
| 5,499,636 | A | 3/1996 | Baggett, Jr. et al. | |
| 5,509,430 | A | 4/1996 | Berger | |
| 5,531,235 | A * | 7/1996 | Hassenboehler, Jr. | 131/332 |
| 5,591,368 | A | 1/1997 | Fleischhauer et al. | |
| 5,607,766 | A | 3/1997 | Berger | |
| 5,620,641 | A | 4/1997 | Berger | |
| 5,633,082 | A | 5/1997 | Berger | |
| 5,678,577 | A | 10/1997 | Matsumura et al. | |
| 5,690,126 | A | 11/1997 | Matsumura et al. | |
| 5,692,527 | A | 12/1997 | Matsumura et al. | |
| 5,709,227 | A | 1/1998 | Arzonico et al. | |
| 5,758,669 | A | 6/1998 | Taniguchi et al. | |
| 5,804,296 | A | 9/1998 | Itoh et al. | |
| 5,817,159 | A | 10/1998 | Cahill et al. | |
| 5,823,201 | A | 10/1998 | Matsumura | |
| 5,856,006 | A | 1/1999 | Asai et al. | |
| 5,863,652 | A | 1/1999 | Matsumura et al. | |
| 5,874,373 | A | 2/1999 | Pryne et al. | |
| 5,911,224 | A | 6/1999 | Berger | |
| 5,915,387 | A | 6/1999 | Baggett, Jr. et al. | |
| 5,927,287 | A | 7/1999 | Matsumura | |
| 5,934,289 | A | 8/1999 | Watkins et al. | |
| 5,947,126 | A | 9/1999 | Wilson et al. | |
| 5,951,744 | A | 9/1999 | Rohrbach et al. | |
| 5,954,059 | A | 9/1999 | Beven et al. | |
| 5,970,988 | A | 10/1999 | Buchanan et al. | |
| 5,979,460 | A | 11/1999 | Matsumura | |
| 5,988,176 | A | 11/1999 | Baggett et al. | |
| 5,998,500 | A | 12/1999 | Cahill et al. | |
| 6,026,820 | A | 2/2000 | Baggett, Jr. et al. | |
| 6,048,614 | A | 4/2000 | Rohrbach et al. | |
| 6,053,176 | A | 4/2000 | Adams et al. | |
| 6,119,691 | A | 9/2000 | Angadjivand et al. | |
| 6,133,439 | A | 10/2000 | Buchanan et al. | |
| 6,202,650 | B1 | 3/2001 | Kaneki et al. | |
| 6,230,901 | B1 | 5/2001 | Ogata et al. | |
| 6,344,239 | B1 | 2/2002 | Asai et al. | |
| 6,432,872 | B1 | 8/2002 | Tsushio et al. | |
| 6,514,325 | B2 | 2/2003 | Cox et al. | |
| 6,521,321 | B2 | 2/2003 | Kahlbaugh et al. | |
| 6,571,802 | B1 | 6/2003 | Yamashita | |
| 6,584,979 | B2 | 7/2003 | Xue et al. | |
| 6,615,843 | B2 | 9/2003 | Pera | |
| 6,616,723 | B2 | 9/2003 | Berger | |
| 6,623,854 | B2 | 9/2003 | Bond | |
| 6,739,344 | B2 | 5/2004 | Yamashita | |
| 6,759,356 | B1 | 7/2004 | Myers | |
| 6,761,174 | B2 | 7/2004 | Jupe et al. | |
| 6,776,168 | B1 | 8/2004 | Teufel et al. | |
| 6,789,547 | B1 | 9/2004 | Paine, III | |
| 6,814,786 | B1 | 11/2004 | Zhuang et al. | |
| 6,837,281 | B2 | 1/2005 | Spiers et al. | |
| 6,907,885 | B2 | 6/2005 | Xue et al. | |
| 6,913,784 | B2 | 7/2005 | Xue et al. | |
| 6,919,105 | B2 | 7/2005 | Xue et al. | |
| RE38,773 | E | 8/2005 | Mark et al. | |
| 6,946,506 | B2 | 9/2005 | Bond et al. | |
| 6,971,387 | B2 | 12/2005 | Michaels | |
| 7,011,096 | B2 | 3/2006 | Li et al. | |
| 7,152,609 | B2 | 12/2006 | Li et al. | |
| 7,165,553 | B2 | 1/2007 | Luan et al. | |
| 7,247,237 | B2 | 7/2007 | Mori et al. | |
| 2002/0020420 | A1 | 2/2002 | Xue et al. | |
| 2003/0118781 | A1 | 6/2003 | Insley et al. | |
| 2003/0154993 | A1 | 8/2003 | Paine, III et al. | |
| 2003/0159703 | A1 | 8/2003 | Yang et al. | |
| 2003/0183237 | A1 | 10/2003 | Xue et al. | |
| 2003/0200973 | A1 | 10/2003 | Xue et al. | |
| 2004/0045566 | A1 | 3/2004 | Pera | |
| 2004/0131770 | A1 | 7/2004 | Xue et al. | |
| 2004/0147397 | A1 | 7/2004 | Miller et al. | |
| 2004/0177855 | A1 | 9/2004 | Garthaffner | |
| 2004/0194792 | A1 | 10/2004 | Zhuang et al. | |
| 2004/0250825 | A1 | 12/2004 | Deevi et al. | |
| 2004/0250827 | A1 | 12/2004 | Deevi et al. | |
| 2005/0000531 | A1 | 1/2005 | Shi | |
| 2005/0126481 | A1 | 6/2005 | Xue et al. | |
| 2006/0130861 | A1 * | 6/2006 | Luan et al. | 131/335 |
| 2006/0144410 | A1 | 7/2006 | Luan et al. | |
| 2008/0314400 | A1 | 12/2008 | Yang et al. | |
| 2009/0075798 | A1 | 3/2009 | Garthaffner | |
| 2010/0006112 | A1 | 1/2010 | Yang et al. | |

FOREIGN PATENT DOCUMENTS

| | | | |
|---|---|---|---|
| DE | 3439907 | A1 | 4/1986 |
| DE | 9309937 | U1 | 8/1993 |
| EP | 0 654 224 | A2 | 5/1995 |
| EP | 0 715 816 | A2 | 6/1996 |
| EP | 1084631 | A1 | 3/2001 |
| EP | 1354522 | A | 10/2003 |
| FR | 2089766 | A | 1/1972 |
| FR | 2290166 | A | 6/1976 |
| GB | 1137870 | | 12/1968 |
| WO | WO 94/07383 | | 4/1994 |
| WO | WO 02/069745 | A | 9/2002 |
| WO | WO2004/014162 | A | 2/2004 |
| WO | WO2004/089124 | A | 10/2004 |
| WO | WO2005/102080 | A | 11/2005 |
| WO | WO 2007/078197 | A2 | 7/2007 |

OTHER PUBLICATIONS

International Preliminary Report on Patentability issued Apr. 11, 2012 for PCT/EP2010/006107.

International Search Report and Written Opinion mailed Nov. 11, 2008 for PCT/IB2008/001842.

International Search Report and Written Opinion dated Jan. 4, 2008 for PCT/IB2007/002237.

International Preliminary Report on Patentability dated Sep. 30, 2008 for PCT/IB2007/002237.

International Search Report and Written Opinion dated Jan. 10, 2008 for PCT/IB2007/002150.

International Preliminary Report on Patentability dated Sep. 30, 2008 for PCT/IB2007/002150.

International Search Report and Written Opinion dated May 4, 2009 for PCT/EP2008/011108.

International Preliminary Report on Patentability issued Dec. 1, 2009 for PCT/IB2008/001842.

International Search Report and Written Opinion mailed May 13, 2011 for International Application No. PCT/EP2010/006107.

International Preliminary Report on Patentability issued Jun. 22, 2010 for PCT/EP2008/011108.

* cited by examiner

METHOD FOR MANUFACTURE OF SMOKING ARTICLE FILTER ASSEMBLY INCLUDING ELECTROSTATICALLY CHARGED FIBER

BACKGROUND

Cigarette filter assemblies may comprise sorbent materials, such as carbon. Filters adapted to be incorporated in a filter cigarette, may comprise, for example, particles or granules of carbon, such as activated carbon or activated charcoal and/or other sorbent materials, incorporated within porous media material, such as cellulose acetate tow, or in cavities between the porous media material.

To the extent that sorbent particles or fragments of sorbent particles could possibly be entrained in the gas stream, such as mainstream smoke, passing through the filter and issue through (i.e., breakthrough) the outlet end of the filter such as the mouth end of a cigarette, techniques to reduce the amount of sorbent particle breakthrough in the gas stream would be of interest.

SUMMARY

An exemplary embodiment of a method of making a smoking article filter assembly is provided in which one or more fibers of charge retaining polymer are formed into a lofty porous network. The lofty porous network of charge retaining polymer fibers is surrounded with a filter wrap to form a filter rod. The one or more fibers of charge retaining polymer are charged.

An exemplary embodiment of an apparatus for manufacturing a filter assembly for a smoking article is provided which comprises a source of lofty porous network of charge retaining polymer fibers to form into a filter rod having a suitable pressure drop. The apparatus includes first and second rollers having protrusions and/or grooves to move the lofty porous network between faces of rollers at high speed without crushing the lofty porous network to a plug wrapping unit which surrounds the lofty porous network with a plug wrap to form the filter rod, and a charging unit to impart an electrostatic charge to the charge retaining polymer fibers before or after the rollers or the plug wrapping unit.

DETAILED DESCRIPTION

Figure 1A:
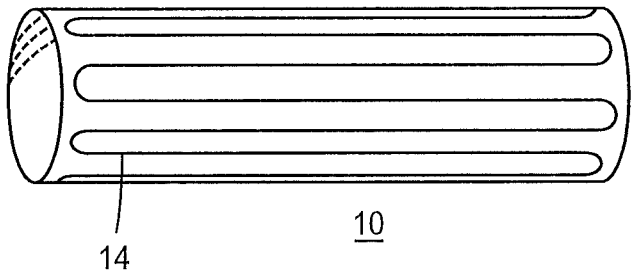
FIG. 1A illustrates an embodiment of a cylindrical filter of a smoking article, such as a cigarette, including a lofty porous network of charge retaining polymer fibers.

As used herein, "fiber" refers to one or more fibers and the "upstream" and "downstream" relative positions between filter segments and other features are described in relation to the direction of gas flow as the gas is filtered in a smoking article. For example, mainstream smoke as it is drawn from the tobacco rod and through a multi-component filter, moves downstream.

As used herein, the term "entrainable particles" describes beads, granules, dust, fines, powders and the like having a diameter of about 0.1 micron to about 10 microns, which may become entrained in a gas stream. For example, smoke entrainable particles, such as carbon or other sorbent material, may become entrained in mainstream smoke.

Plug-space-plug filters may include a portion of activated carbon between plugs of axially oriented cellulose acetate fibers. As smoke is drawn downstream from the tobacco rod and through the filter, some carbon particles may pass through channels between the individual cellulose acetate fibers. The plug-space-plug filter is typically attached to the tobacco rod that is wrapped with a paper wrapper to form a smoking article. Tipping paper surrounds the filter and affixes the filter to the tobacco rod.

As described herein, a filter assembly for a smoking article produces potentially reduced and/or eliminated particle breakthrough during smoking by using an electrostatic charge to attract particles and optionally also a random orientation of electrostatically charged fibers to mechanically trap particles. "Random orientation" describes portions of the electrostatically charged fibers running more or less at random in non-parallel diverging and converging directions. Optionally, electrostatically charged fibers can be randomly oriented primarily in a longitudinal direction of the filter, primarily in a transverse direction, or primarily in another direction.

In a preferred embodiment charge retaining polymer fibers are combined in a porous network having a predetermined loft and the polymer fibers are electrostatically charged. "Loft" describes a woven or non-woven network of charge retaining polymer fibers incorporating a high percentage of airspace between the fibers giving the lofty porous network a low density. Generally, a network lacking in loft or significant thickness has charge retaining polymer fibers comprising the non-lofty porous network oriented substantially in the X-Y plane of the non-lofty porous network. Adding a true Z-direction orientation to the charge retaining polymer fibers outside of the plane of the network forms a lofty porous network. Preferably, the airspace in the lofty porous network is about 20-95% by volume (e.g., about 20-40%, 40-60%, 60-80%, 80-95%). More preferably, the airspace is about 60-80% by volume (e.g., about 60-65%, 65-70%, 70-75%, 75-80%). For example, a sheet of lofty porous network will have a greater thickness than a sheet of non-lofty porous network for the same weight (denier) of fiber and sheet size. Preferably the porosity and loft of the lofty porous network are adapted to achieve a suitable pressure drop across the portion of the filter assembly formed of the lofty porous network. A suitable pressure drop for a filter assembly is in a range of 90 to 180 mm $H_2O$ at a flow rate of 17.5 $cm^3/s$. "Pressure drop" is the pressure required to draw air through a filter rod at a constant flow rate of 17.5 $cm^3/s$. Pressure drop is also referred to as "draft" or "resistance to draw."

In a preferred embodiment, the sorbent is activated carbon. Preferably, the lofty porous network of charge retaining polymer fibers is located downstream of the activated carbon contained within the filter assembly so that as gas (e.g., smoke) is drawn through the filter assembly the carbon particles, having a size of about 0.1 micron to about 10 microns, entrained in the gas are retained by the electrostatically charged fibers of the porous network.

In a preferred embodiment, illustrated in FIG. 1A, the filter assembly 10 includes a lofty porous network of charge retaining polymer fibers 14. The porous network can be formed from the charge retaining polymer fibers by a number of ways. For example, the charge retaining polymer fibers can be cut into discrete lengths of fibers, bundled and bonded, or a continuously supplied fiber can be bundled and bonded to form the lofty porous network. The fibers can be mechanically, thermally and/or chemically bonded where bundled fiber surfaces contact each other. For example, mechanical bonding can form a lofty porous network of the charge retaining polymer fibers by needle punching, and/or hydroentangling the fibers. Chemical bonding can include such methods as bonding with adhesives, bonding with latex resin, and/or bonding with hot melt adhesive. Thermal bonding can include techniques such as partial melt bonding of fibers, bonding the fibers on a heated calender roll, and/or bonding newly formed fibers while still hot from the fiber forming process to form the lofty porous network.

Figure 1B:
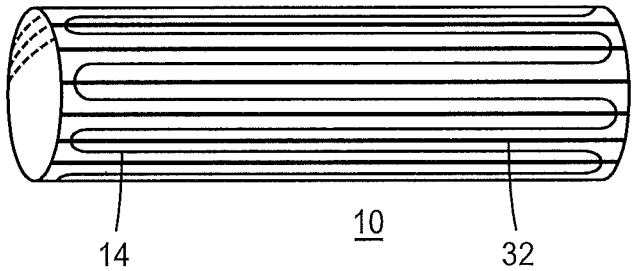
FIG. 1B illustrates another embodiment of a cylindrical filter of a smoking article, such as a cigarette, including a lofty porous network of charge retaining polymer fibers and mediating filter fibers.

In a preferred embodiment, the filter assembly 10 is a lofty porous network of charge retaining polymer fibers 14 and mediating filter fibers 32, as shown in FIG. 1B. Mediating filter fibers 32 are non-charge retaining fibers. Such mediating filter fibers 32 can be fibers of polyester and/or cellulose acetate with or without a plasticizer. For example, mediating filter fibers 32 such as cellulose acetate fibers can be incorporated in the lofty porous network 14 during bonding of the charge retaining fibers by thermal bonding such that no plasticizer is required. Mediating filter fibers 32 can partially fill the filter rod with the lofty porous network of charge retaining polymer fibers to achieve a desired pressure drop, filtration efficiency, separation of charge retaining polymer fibers, and/or hardness of the filter rod.

Figure 2:
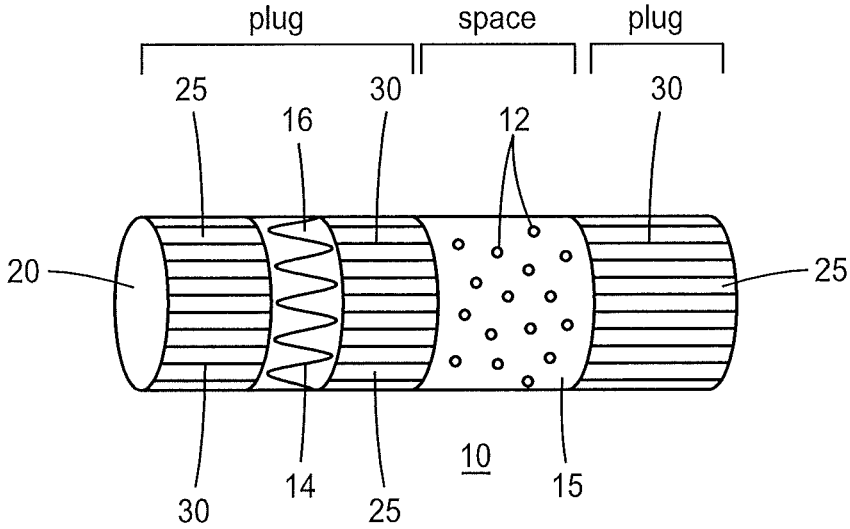
FIG. 2 illustrates an embodiment of a plug-space-plug filter including a plug of charge retaining polymer fibers in a lofty porous network.

In a preferred embodiment, illustrated in FIG. 2, the filter assembly 10 is a plug-space-plug type filter assembly. Preferably, a portion of activated carbon 12 is located in the cavity 15 of the filter 10, and a plug 16 of lofty porous network of electrostatically charged polymer fibers 14 is located downstream of the activated carbon 12 to reduce carbon particle breakthrough as mainstream smoke passes through the filter assembly 10. Preferably, the portion of activated carbon 12 is included as a plug of carbon on tow filter material, carbon paper, and/or a bed of loose carbon beads, granules, particles, and the like in the cavity 15 of the filter. The electrostatically charged fibers have permanent electrostatic charges (charged as described below), which can capture the carbon particles, thereby reducing or eliminating carbon particle breakthrough as mainstream smoke travels through the filter. In an embodiment, the electrostatically charged fibers are randomly-oriented so as to also mechanically capture smoke entrainable particles.

The charge retaining polymer fibers in the lofty porous network 14 can be charged at any time, however, charging the fibers after forming the fibers into a network is preferred because charged fibers and/or portions of a fiber not formed into a network tend to repel one another. Charging the charge retaining polymer fibers can be accomplished by such techniques as tribo-electrification charging, corona charging, electron beam charging, ion beam charging, radiation charging, and/or boundary charging. For example, commonly-owned U.S. Pat. No. 6,919,105, incorporated herein by reference in its entirety, describes batch charging a sample mat of fibers. Preferably, the charge retaining polymer is a polyethylene, a polypropylene, polyvinylidene difluoride, polytetrafluoroethylene, nylon, polyesters, polyamides or combinations thereof. The charge retaining polymer fibers are positively charged, negatively charged or both positively and negatively charged, depending on the process(es) used for charging.

In a preferred embodiment, the charge retaining fibers include electret fibers (e.g., 3M Filtrete™ fiber). Preferably, electret fibers have a diameter of about 3 micrometers to about 30 micrometers and a basis weight in the range of about 10 to about 500 $g/m^2$. Preferably, the electret fibers range in weight from about 2.5 denier to about 8 denier. Preferred fibers have a Y-shaped cross-section.

Also preferably, the filter assembly includes about 30 mg to about 200 mg of sorbent. In a preferred embodiment, the filter assembly 10 also includes about 25 mg to about 75 mg of lofty porous network of charge retaining polymer fibers 14, which forms a plug of about 3 mm to about 6 mm in length. Preferably, the amount of lofty porous network 14 used depends on the amount of sorbent, such as activated carbon, contained within the filter assembly 10. In a preferred embodiment, a plug of lofty porous network 14 having a plug length of at least 1 mm (e.g., at least 2 mm, 3 mm or 4 mm) is used for about 18 mg of activated carbon.

In a preferred embodiment, the sorbent and/or smoke entrainable particles include any suitable sorbent media. Exemplary sorbents include molecular sieves such as zeolites, silicas, silcates, aluminas, and/or carbons (e.g., activated carbon). A preferred sorbent media is activated carbon.

By "activated carbon" is meant any porous, high surface area form of carbon that can be used as a sorbent in filters. Activated carbon can be derived via thermal treatment of any suitable carbon source. The activation treatment typically increases the porosity, and activated carbon can be provided with a wide range of pore sizes or the pore sizes can be controlled to provide a desired pore size distribution.

In a preferred embodiment, the carbon is in the form of granules and the like. Preferably, the carbon of the preferred embodiment is a high surface area, activated carbon, for example a coconut shell based carbon of typical ASTM mesh size used in the cigarette industry or finer. A particularly preferred activated carbon is commercially available from PICA USA, Inc., Truth or Consequences, N. Mex. The activated carbon could also be manufactured via the carbonization of coal, wood, pitch, peat, cellulose fibers, lignite and olive pits. Carbonization is usually carried out at elevated temperatures, e.g., 400-1000° C. in an inert atmosphere, followed by activation under reducing or oxidizing conditions.

In a preferred embodiment, the activated carbon can be in the form of beads. In other embodiments, the activated carbon can be in the form of granules and/or fibers. Preferably, the activated carbon is adapted to adsorb constituents of mainstream smoke, particularly, those of the gas phase including aldehydes, ketones and other volatile organic compounds, and in particular 1,3-butadiene, acrolein, isoprene, propionaldehyde, acrylonitrile, benzene, toluene, styrene, acetaldehyde and hydrogen cyanide.

In other embodiments, the carbon can be in the form of carbon on tow and/or carbon paper.

Most preferably, the activated carbon comprises granulated particles ranging in size from about 100 microns to about 5 mm. In an embodiment, the particles of activated carbon have an average size of from about 0.2 to 2 mm (e.g., about 200, 500, 1000 or 2000 microns). Activated carbon beads contained in the filter assembly preferably range in size from 0.20 mm to about 0.7 mm, as described in commonly-assigned U.S. Patent Application Publication No. 2003/0154993, the entire content of which is incorporated herein by reference.

Preferably, activated carbon can have any desired pore size distribution that comprises pores, such as micropores, mesopores and macropores. The term "microporous" generally refers to such materials having pore sizes of about 20 Angstroms or less while the term "mesoporous" generally refers to such materials with pore sizes of about 20-300 Angstroms. "Macroporous" generally refers to such materials with pore sizes greater than about 300 Angstroms.

In an embodiment, the activated carbon can be selected to have an appropriate surface area to preferentially adsorb targeted constituents from smoke. For example, the preferred activated carbon typically has a surface area greater than about 50 $m^2/g$ (e.g., at least about 100, 200, 500, 1000 or 2000 $m^2/g$). Typically, the adsorptive capacity of the activated carbon increases with increasing surface area.

Furthermore, surface area to volume typically increases with decreasing particle size. When used as cigarette filter material, however, carbon particles having a small particle size may pack together too densely to permit smoke to flow through the filter with desired resistance to draw (RTD) during smoking. On the other hand, if the particle size is too large there may be insufficient surface area to accomplish the desired degree of filtration. Therefore, such factors can be taken into account in selecting carbon particles suitable for filtration of mainstream and/or sidestream smoke.

Optionally, at least some, if not all of the activated carbon is flavor-bearing or otherwise impregnated with a flavorant so that the carbon is adapted not only to remove one or more gas phase smoke constituents from smoke, but also to release flavor into the mainstream smoke stream. Preferably, the flavorant is added to the carbon by spraying flavorant upon a batch of activated carbon in a mixing (tumbling) drum, or alternatively in a fluidized bed with nitrogen as the fluidizing agent, wherein flavorant may then be sprayed onto the carbon in the bed as described in commonly-assigned U.S. Pat. No. 6,761,174 to Jupe et al., the entire content of which is incorporated herein by reference.

The term "mainstream" smoke refers to the mixture of gases passing down the tobacco rod and issuing through the filter end, i.e., the amount of smoke issuing or drawn from the mouth end of a smoking article such as a cigarette during smoking of the cigarette. The mainstream smoke contains smoke that is drawn in through both the lighted region, as well as through the cigarette paper wrapper. The term "side stream" smoke refers to smoke produced during static burning.

As seen in FIG. 2, preferably, the buccal end 20 of the filter assembly 10 is in the form of a plug 25 of cellulose acetate fibers 30. Preferably, the cellulose acetate fibers 30 are axially oriented with respect to the filter assembly 10. Preferably, the plug 25 is positioned downstream of a plug 16 of lofty porous network of charge retaining polymer fibers 14, which is also downstream of the activated carbon 12. In an embodiment, the charge retaining polymer fibers of the lofty porous network 14 are randomly oriented. In another embodiment, the charge retaining polymer fibers of the lofty porous network 14 are axially oriented. Preferably, the activated carbon 12 is held in cavity 15. A second plug 25 of cellulose acetate fibers 30 is located immediately upstream of the lofty porous network of charge retaining polymer fibers 14, and immediately downstream of the activated carbon 12.

In a preferred embodiment, the filter assembly 10 contains about 40 mg to about 70 mg of cellulose acetate fibers. Preferably, one or more plugs of cellulose acetate fibers are added to adjust the length of the filter.

If carbon particles become entrained in the mainstream smoke, the electrostatically charged fibers attract and capture the carbon particles to reduce carbon particle breakthrough. Preferably, the electrostatically charged fibers have permanent electrostatic charges so that the carbon particles are captured in the filter.

In an embodiment, when the charge retaining polymer fibers are randomly oriented, carbon particles are also captured mechanically because the carbon particles are not able to travel unimpeded in channels between the fibers.

Figure 3:
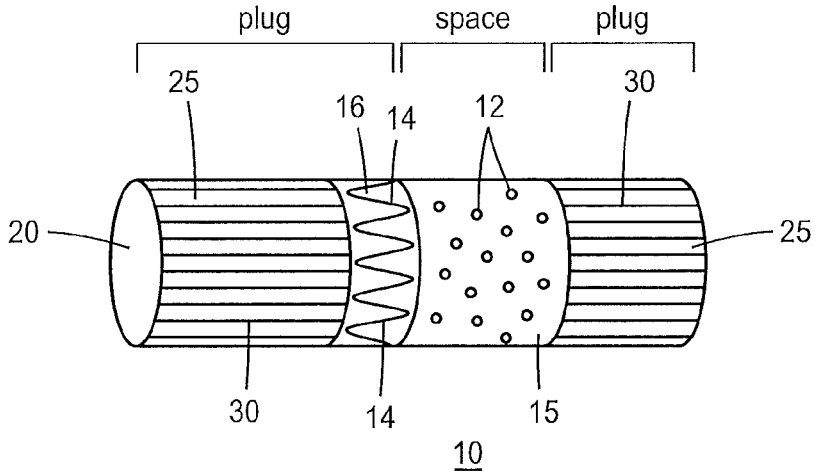
FIG. 3 illustrates a second embodiment of a plug-space-plug filter including a plug of charge retaining polymer fibers in a lofty porous network.

In another embodiment, as illustrated in FIG. 3, the filter assembly 10 includes a portion of activated carbon 12. Preferably, a plug 16 of lofty porous network of charge retaining polymer fibers 14 is located immediately downstream of the activated carbon 12. Plugs 25 of cellulose acetate fibers 30 are located immediately upstream of the activated carbon 12 and immediately downstream of the lofty porous network of charge retaining polymer fibers 14.

Figure 4:
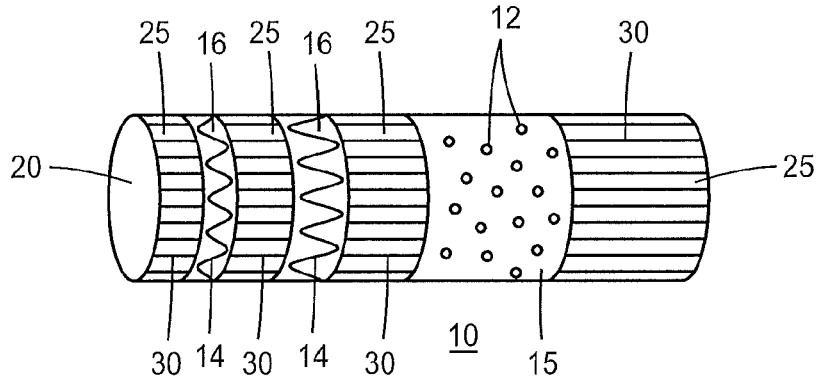
FIG. 4 illustrates a third embodiment of a plug-space-plug filter including plugs of charge retaining polymer fibers in lofty porous networks.

In yet another embodiment, as illustrated in FIG. 4, the filter assembly 10 includes a portion of activated carbon 12. Preferably, a plug 25 of cellulose acetate fibers 30 is located immediately downstream and immediately upstream of the cavity 15 filled with a plug of activated carbon 12.

Figure 5:
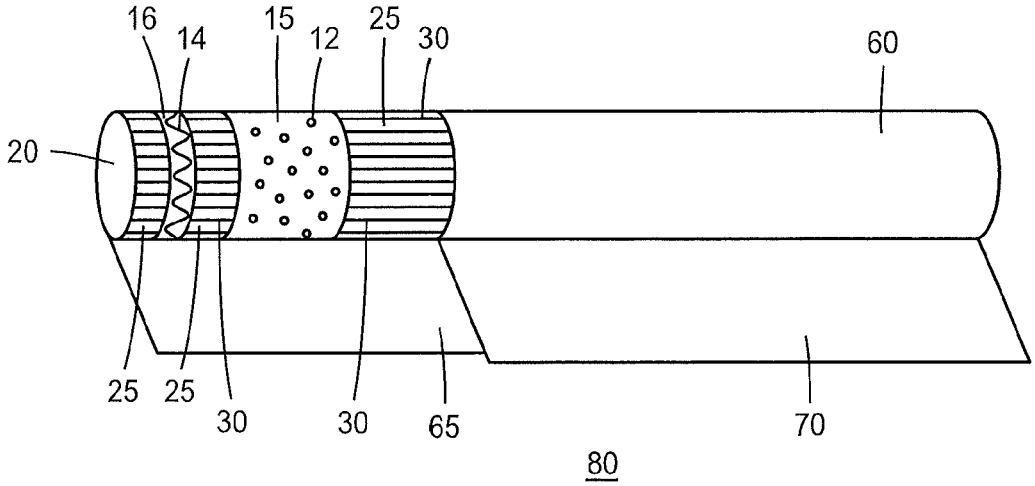
FIG. 5 illustrates a partially unwrapped smoking article including a plug-space-plug filter including a plug of charge retaining polymer fibers in a lofty porous network.

As seen in FIG. 5, the filter assembly 10 is adapted to be incorporated in a smoking article 80.

As used herein, the term "smoking article" includes cigarettes, cigars, pipes, and cigarillos. Non-traditional cigarettes such as cigarettes for electrical smoking systems, as described in commonly-assigned U.S. Pat. Nos. 7,163,015; 6,615,840; 6,026,820; 5,988,176; 5,915,387; and 5,499,636, the entire contents of which are hereby incorporated by reference, are also included in the definition of smoking articles or cigarettes generally.

Preferably, the smoking article is a cigarette. The cigarette may contain tobacco material and a filter. In an embodiment, the cigarette may also contain at least one sorbent 12. A traditional cigarette typically contains two sections, a tobacco-containing portion sometimes referred to as the tobacco rod 60, and a filter portion 10 which may be referred to as the filtration zone. Tipping paper 65 typically surrounds the filter 10, which forms the buccal end of the cigarette. The tipping paper 65 overlaps with the tobacco rod 60 in order to hold the filter assembly 10 and tobacco rod 60 together. The tobacco rod 60, or tobacco containing element of the cigarette includes the paper wrapper 70 in which the tobacco is wrapped and the adhesive holding the seams of the paper wrapper 70 together. The tobacco rod 60 has a first end which is integrally attached to the filter assembly 10 and a second end which is lit or heated for smoking the tobacco.

As previously mentioned, the lofty porous network of charge retaining polymer fibers can be formed from a charge retaining polymer by thermally, mechanically or chemically bonding a continuous fiber filament or a bundle of fibers with or without mediating filter fibers and with or without plasticizers into a woven or non-woven mat. In an embodiment, the filter assembly for a smoking article can be made by crimping such a mat to form a tow band and then processing the tow band in a filter making apparatus where a filter wrap is put on the tow band to form a filter rod. In an alternative embodiment, the fiber or bundle of fibers can be processed into continuous woven or non-woven media with or without the mediating filter fibers, then slit into a desired width to replace tow bands in a filter rod-forming unit, such as a KDF filter rod-forming machine manufactured by Hauni, or punched into cylindrical disks with desired diameters and depths to serve as sections supplied directly to a cigarette filter combiner, such as a ND-3 filter combiner machine manufactured by Hauni. The cylindrical disks serve as sections in a cigarette filter.

In another embodiment of a process of making the filter rods, the crimped tow bands, bundles of the fibers, or the slit continuous woven or non-woven media of the charge retaining polymer fiber is pulled into a preformed cylindered filter wrap tube, and then cut to filter rods with desired lengths. Electrostatic charge on the charge retaining polymer fiber can be introduced on the fiber filament, the fiber bundles, the formed tow bands, the woven or non-woven media or the formed filter rods during the process. For example, an approximately 2.0-cm wide slit (e.g., 1.5, 1.7, 1.9, 2.2, 2.5 or 2.7 cm wide slit) of charged non-woven media made of polypropylene and polyester (Toyobo Elitolon Electret Media) can be folded and pulled through a pre-formed cylindrical filter wrapping tube with a hook. A tool can be threaded through the cylindrical filter wrapping tube to hook the lofty porous network and drawing the tool through the cylindrical tube, move the lofty porous network into the cylindrical tube filling the cylindrical tube with the lofty porous network, followed by detaching the tool.

The formed cylinder filled with lofty porous network can be trim cut into an about 3-9 mm (e.g., about 6 mm) long, about 5-10 mm (e.g., about 7.5 mm) in diameter filter sections (weight 60-70 mg). Such sections can be combined with other filter components to form a filter assembly containing about 50-150 mg (e.g., about 110 mg) of granular carbon.

Also provided is a method of making a filter assembly including filling a cavity of a plug-space-plug filter assembly with sorbent, such as activated carbon particles, wherein a plug of lofty porous network of charge retaining polymer fibers is located downstream of the cavity. In an embodiment, the plug of lofty porous network of charge retaining polymer fibers is located immediately downstream of the activated carbon (see, e.g., FIG. 3). In another embodiment, the lofty porous network of charge retaining polymer fibers is located downstream of the activated carbon, and a plug of cellulose acetate fibers is located at the mouth end of the filter. Preferably, the electrostatically charged fibers in the lofty porous network are randomly-oriented within a plug of filter material. In another embodiment, the electrostatically charged fibers are axially oriented in a plug of filter material.

In a preferred embodiment, a plug of axially oriented cellulose acetate fibers is placed upstream of the activated carbon. In another preferred embodiment, a plug of axially oriented cellulose acetate fibers is placed upstream and downstream of the plug of lofty porous network of charge retaining polymer fibers, or of the activated carbon.

"2-up plugs of filter material" refers to a plug construction such that if it were divided into two pieces, would render two complete plugs of filter material. Similarly, a "4-up filter assembly" would, if separated into four pieces, provide four complete filter assemblies each comprising upstream and downstream plugs of filter material with a plug including the lofty porous network and a cavity having sorbent between the upstream and downstream plugs of filter material as described in connection with the filter assembly of the preferred embodiments.

In a preferred embodiment, a method is provided for forming smoking articles. Preferably, 2-up plugs of filter material are spaced apart to form 4-up filter assemblies and plugs including the lofty porous network are placed between the 2-up plugs such that cavities are formed at upstream and downstream ends of every other 2-up plug. Sorbent including smoke entrainable sorbent particles are preferably placed in the cavities and the 4-up filter assemblies are cut centrally to form 2-up filter assemblies. Preferably, a tobacco rod is attached to each end of the 2-up filter assemblies and the 2-up filter assemblies are centrally cut to form complete cigarettes.

Figure 6:
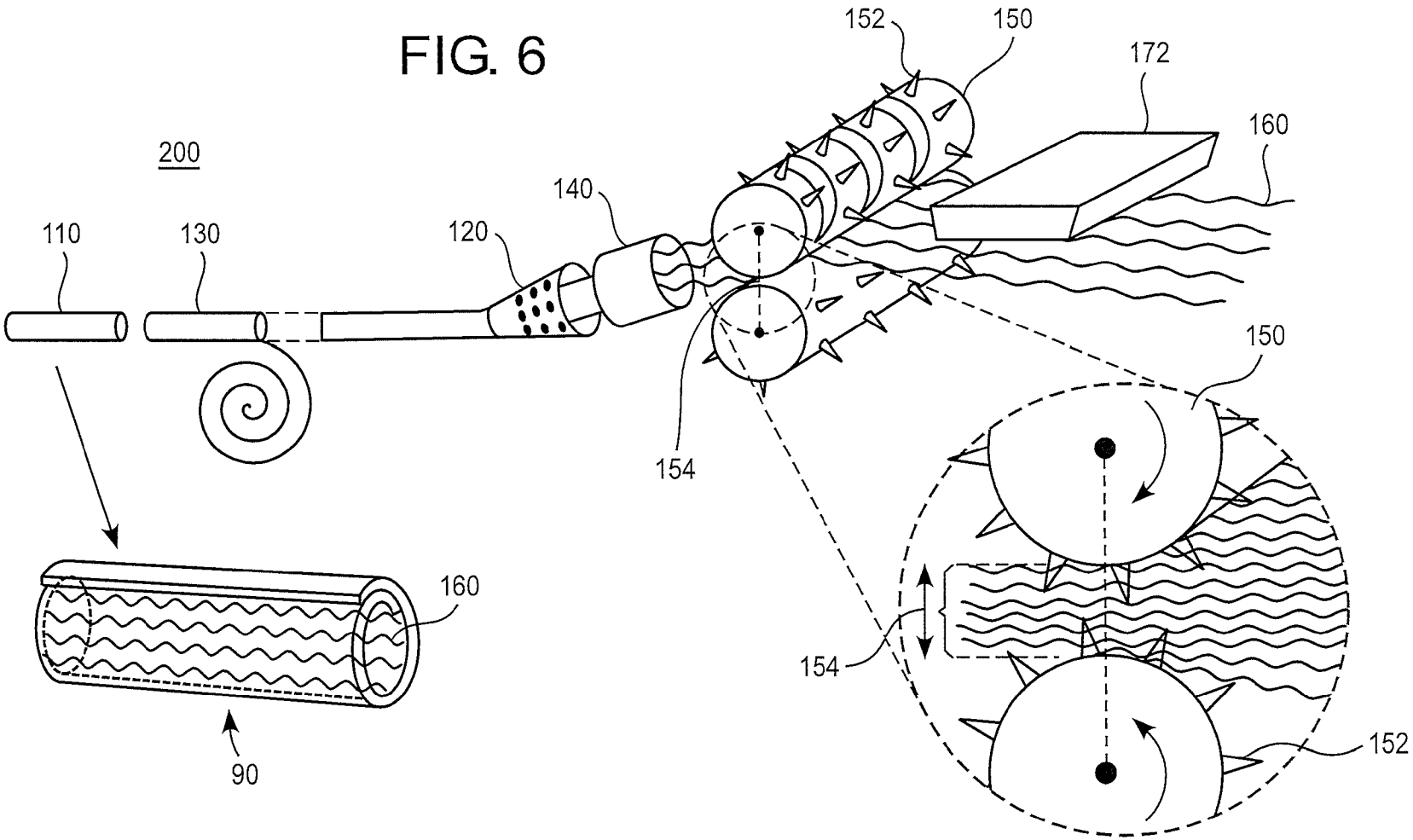
FIG. 6 illustrates an embodiment of an apparatus for manufacturing a filter assembly at least partially including a lofty porous network of charge retaining polymer fibers.

Also provided is an apparatus 200 adapted to form a tubular filter including a lofty porous network of charge retaining polymer fibers. As illustrated in FIG. 6, a preferred embodiment of the apparatus includes a source of continuous lofty porous network of charge retaining polymer fibers (woven or non-woven with or without mediating filter fibers) 160 formed into a filter rod 90 while maintaining a desired loft to the lofty porous network 160. FIG. 6 shows the continuous porous network 160 as it moves past an optional plasticizer applicator unit 172. In the preferred embodiment, the lofty porous network 160 is moved by delivery rollers 150 into a garniture unit 120. The delivery rollers 150 are spaced apart by a gap 154 and have spiked teeth 152 to punch, push and pull the fiber media to the garniture unit 120 with minimal crushing of the loft from the porous network of charge retaining polymer fibers 160. Preferably, an airjet (stuffer jet) unit 140 pushes the lofty porous network 160 into the garniture unit 120. In the embodiment shown in FIG. 6, a wrapping unit 130 wraps the lofty porous network 160 in a filter plug wrap to form a filter rod and a cutting unit 110 cuts the filter rod 90 to predetermined lengths. Preferably, such a filter rod 90 can be used in a filter assembly such as a cigarette filter after the charge retaining polymer fiber is given an electrostatic charge. Such tubular filters provide efficient filtering, suitable pressure drop and a compact size.

Figure 7:
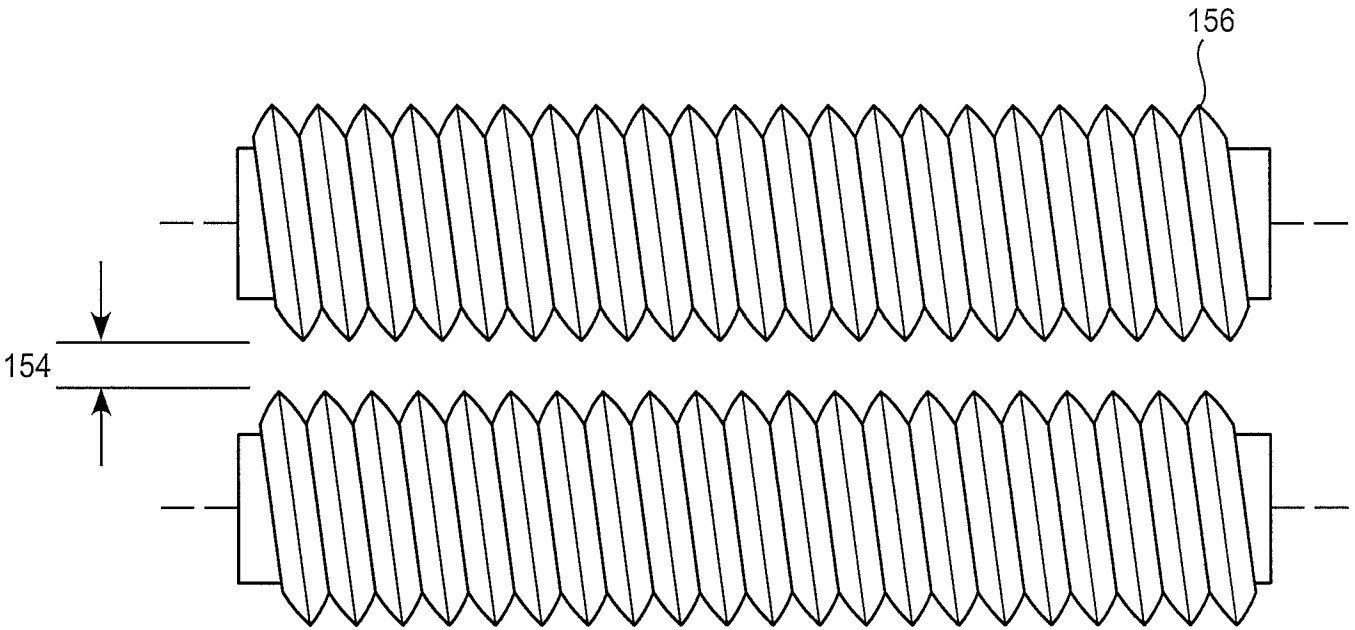
FIG. 7 illustrates an embodiment of threaded first and second delivery rollers for use in an embodiment of a filter assembly manufacturing apparatus for manufacturing a filter including a lofty porous network of charge retaining polymer fibers.

FIG. 7 shows an embodiment of delivery rollers 150 spaced apart by a gap 154 and having threaded grooves 156 to move the fiber media to the garniture unit 120 and the airjet 140 (FIG. 6) with minimal crushing of the loft from the lofty porous network of charge retaining polymer fiber 160. By "minimal crushing" it is meant that some crushing of the loft occurs by the delivery rollers 150 to move the lofty porous network ahead and to achieve a desired pressure drop in a filter. However, at least a portion of the network structure maintains loft or elastically springs back to a lofty porous network after passing the delivery rollers. Minimal crushing preferably encompasses no crushing of the loft from the lofty porous network of charge retaining polymer fiber 160. Protrusions on the delivery rollers 150 for moving the lofty porous network at high speed with minimal crushing are not particularly limited and may be, by way of example, spikes, teeth, screw threads, grooves, abrasive particles, mesas, beads, bristles or a combination thereof in a number and arranged in a pattern on the rollers 150 to feed the lofty porous network ahead at a high speed and with minimal crushing. One protrusion on each delivery roller can be sufficient, but preferably, a plurality of protrusions on each roller are used for high speed operation. Preferably, the rollers 150 feed the lofty porous network ahead at a high speed between about 100 and 600 m/min, e.g., at about 100 to 200 m/min, about 200 to 300 m/min, about 300 to 400 m/min, about 400 to 500 m/min, or about 500 to 600 m/min.

Figure 8A:
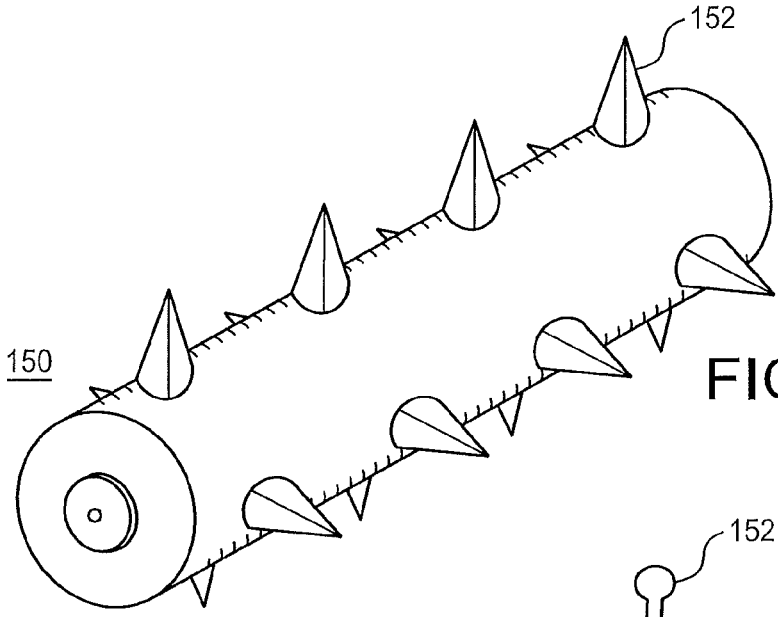
FIG. 8A illustrates another embodiment of a delivery roller having pointed teeth for use in an embodiment of a filter assembly manufacturing apparatus for manufacturing a filter including a lofty porous network of charge retaining polymer fibers.
Figure 8B:
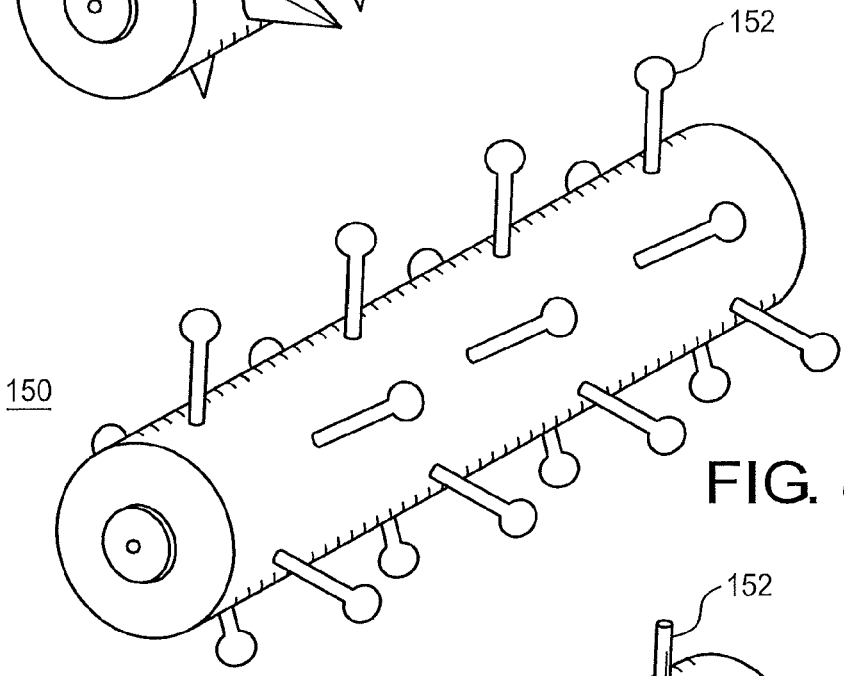
FIG. 8B illustrates another embodiment of a delivery roller having beaded prongs for use in an embodiment of a filter assembly manufacturing apparatus for manufacturing a filter including a lofty porous network of charge retaining polymer fibers.
Figure 8C:
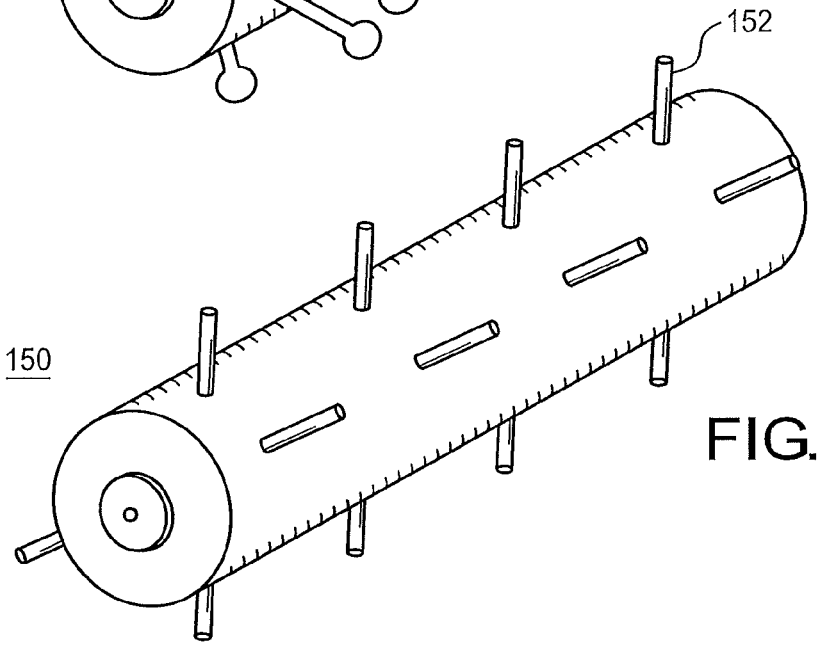
FIG. 8C illustrates another embodiment of a delivery roller having cylindrical pegs for use in an embodiment of a filter assembly manufacturing apparatus for manufacturing a filter including a lofty porous network of charge retaining polymer fibers.

FIGS. 8A-8C show alternative embodiments of delivery rollers 150 to move the fiber media to the garniture unit 120 and the airjet 140 with minimal crushing of the loft from the lofty porous network of charge retaining polymer fibers 160. In embodiments, the protrusions 152 can be spikes as shown in FIG. 8A, beaded rods as shown in FIG. 8B and/or cylindrical pegs as shown in FIG. 8C. Such texture and protrusions 152 on rollers 150 can be made of polymers, ceramics, metal, natural fibers such as boars hair or a combination of these and other suitable materials without limitation.

Figure 9A:
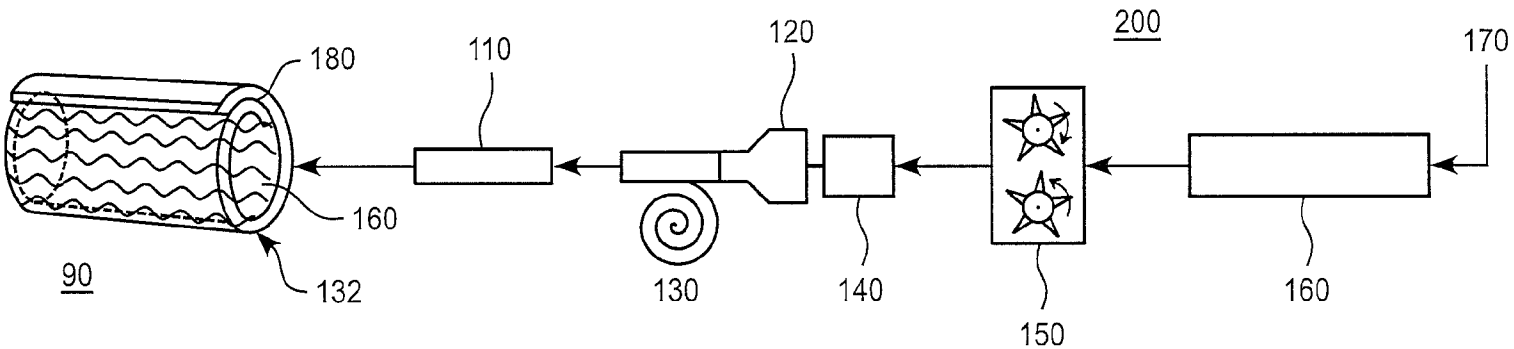
FIG. 9A shows a diagram of an embodiment of an apparatus for manufacturing a filter including a lofty porous network of charge retaining polymer fibers.

FIG. 9A shows a diagram of an embodiment of the apparatus 200 adapted to form a tubular filter including a lofty porous network of charge retaining polymer fibers. In the diagram, a source of continuous lofty porous network of charge retaining polymer fibers (woven or non-woven with or without mediating filter fibers) 160 is formed from fiber filament of charge retaining polymer 170. It is intended that the fiber filament of charge retaining polymer 170 can be a continuous fiber or a bundle of fibers cut into discrete lengths. The fiber or fibers are chemically, thermally, or mechanically bonded with or without mediating filter fibers. The non-woven lofty porous network of charge retaining polymer fibers may be uniform or non-uniform. Preferably, the non-woven lofty porous network of charge retaining polymer fibers includes randomly oriented fibers cut into discrete lengths. The lofty porous network of charge retaining polymer fibers can alternatively be of woven fibers and optionally be chemically or thermally bonded with or without mediating filter fibers. FIG. 9A shows the continuous lofty porous network 160 fed by delivery rollers 150 to an airjet unit 140 and into a garniture unit 120. Delivery rollers 150 feed the fiber media to the garniture unit 120 at high speed with minimal crushing of the loft from the lofty porous network of charge retaining polymer fibers 160. In the diagram shown in FIG. 9A, a wrapping unit 130 wraps the lofty porous network 160 in a filter wrap 132 and seals the filter wrap 132 with a strip of adhesive 180 to form a filter rod 90 and a cutting unit 110 cuts the filter rod 90 to predetermined lengths. The charge retaining polymer fibers can be charged during the process at a selected location or optionally, the charge retaining polymer fibers can be charged after the filter rod 90 is cut to predetermined lengths.

Figure 9B:
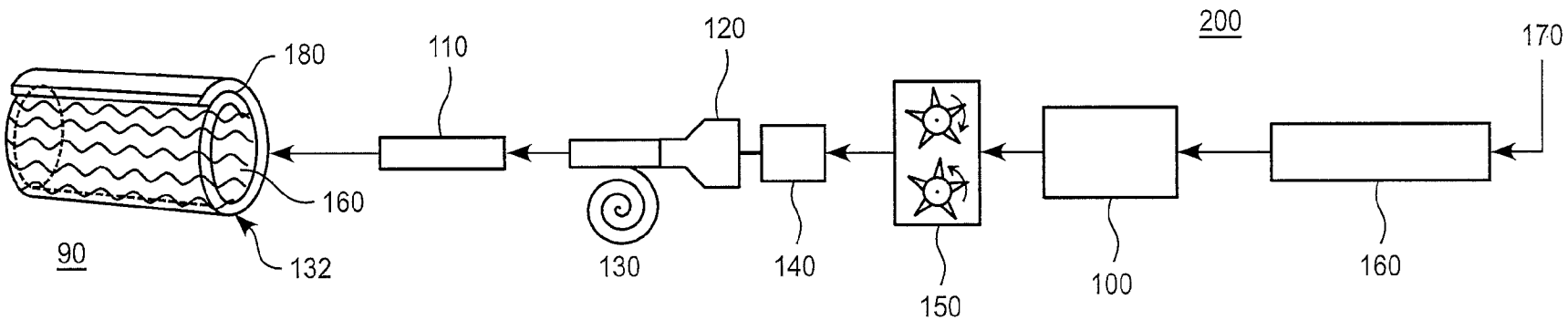
FIG. 9B shows a diagram of another embodiment of an apparatus for manufacturing a filter of a lofty porous network of charge retaining polymer fibers, in which the apparatus includes a charging unit before delivery rollers.

FIG. 9B shows a diagram of the apparatus 200 for manufacturing a filter of a lofty porous network of charge retaining polymer fibers 160, the apparatus 200 including a charging unit 100 located after the fiber(s) 170 has/have been formed into a lofty porous network 160 and before the delivery rollers 150. In another embodiment of the apparatus 200 for manufacturing a filter of a lofty porous network of charge retaining polymer fibers 160 (not shown), the apparatus 200 includes the charging unit 100 after delivery rollers 150 and before the garniture unit 120. In another embodiment of the apparatus 200 for manufacturing a filter of a lofty porous network of charge retaining polymer fibers 160 (not shown), the apparatus 200 includes the charging unit 100 after a garniture unit 120 and before a cutting unit 110.

Figure 9C:
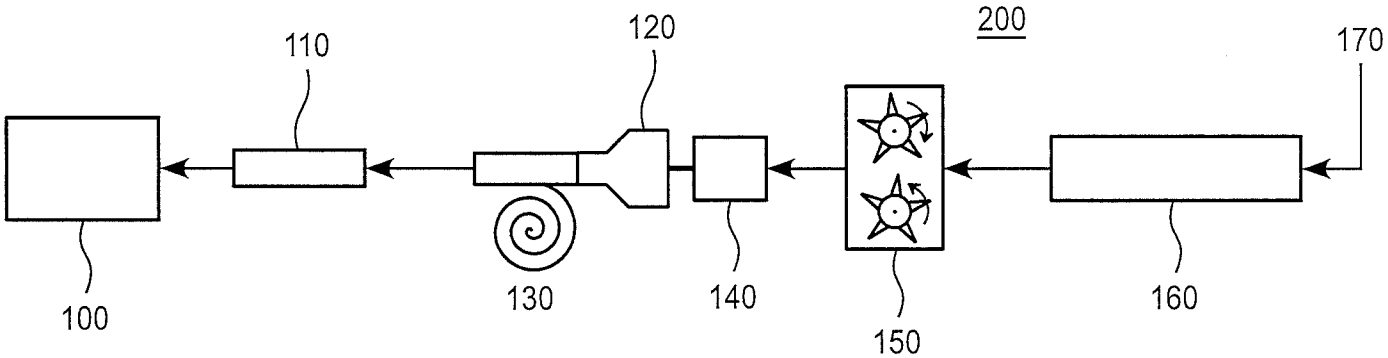
FIG. 9C shows a diagram of another embodiment of an apparatus for manufacturing a filter of a lofty porous network of charge retaining polymer fibers, in which the apparatus includes a charging unit after a cutting unit.
Figure 9D:
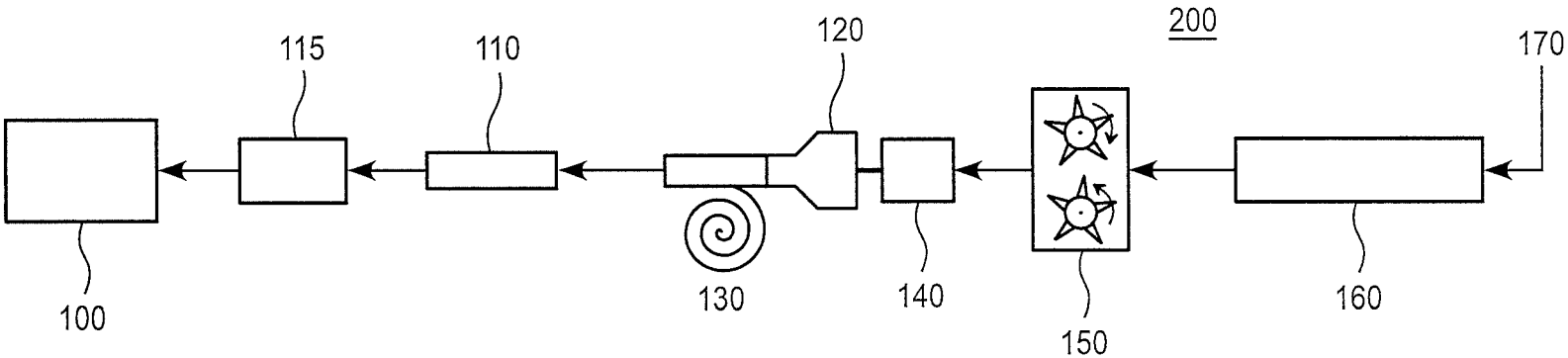
FIG. 9D shows a diagram of another embodiment of an apparatus for manufacturing a filter of a lofty porous network of charge retaining polymer fibers, in which the apparatus includes a charging unit after a tipping unit where the filter is joined to a tobacco rod.

FIG. 9C shows a diagram of an embodiment of the apparatus 200 for manufacturing a filter of a lofty porous network of charge retaining polymer fibers 160, the apparatus 200 including the charging unit 100 after the cutting unit 110. FIG. 9D shows a diagram of an embodiment of the apparatus 200 for manufacturing a filter of a lofty porous network of charge retaining polymer fibers 160, the apparatus 200 including the charging unit 100 after a tipping unit 115 where the filter 90 is joined to a tobacco rod such as shown in FIG. 5.

Figure 10A:
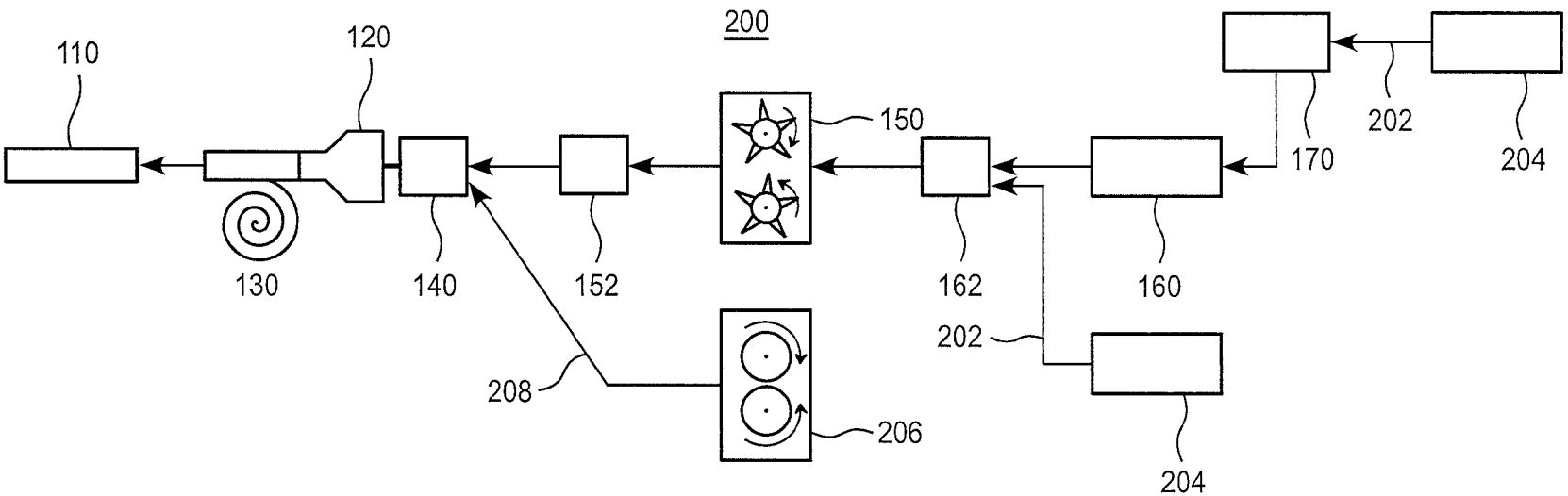
FIG. 10A shows a diagram of another embodiment of an apparatus for manufacturing a filter including a lofty porous network of charge retaining polymer fibers including optional mediating filter fibers and tow band, in which the apparatus includes an optional plasticizer unit, slitter unit, and tow band delivery rollers.

FIG. 10A shows a diagram of alternative embodiments of the apparatus 200 for manufacturing a filter of a lofty porous network of charge retaining polymer fibers 160, the apparatus 200 includes optional units for incorporating mediating filter fibers and combining with tow bands in a filter rod-forming unit. In the embodiment shown in FIG. 10A, mediating filter fibers 202 can be incorporated with a continuous charge retaining fiber or bundle of cut charge retaining fibers 170 by the mediating filter fiber unit 204 before and/or after the charge retaining fibers are mechanically, thermally and/or chemically bonded into the lofty porous network 160. For example, after the charge retaining fibers are mechanically, thermally and/or chemically bonded into the lofty porous network 160, mediating filter fibers 202 can be bonded to the lofty porous network 160 by a placticizer applicator 162 by addition of a placticizer.

In the embodiment shown in FIG. 10A, the apparatus 200 includes optional units for combining the lofty porous network of charge retaining polymer fibers 160 with tow bands in a filter rod-forming unit. The continuous woven or non-woven lofty porous network of charge retaining polymer fibers 160 with or without the mediating filter fibers 202 can be slit into desired width in a slitting unit 152 to replace tow bands 208 in the filter rod-forming unit 200 (such as the KDF rod forming unit manufactured by Hunai). Delivery rollers 206 deliver tow band 208 to the airjet 140 to form the tow band 208 into the filter rod 90 (see, e.g., FIG. 9B). Such a filter rod 90 may have the lofty porous network of charge retaining polymer fibers 160 surrounding an acetate filter tow surrounded by the filter paper 132. FIG. 10C shows a cross section of an embodiment of a filter rod 90 having a core of cellulose acetate 32 surrounded by the lofty porous network of charge retaining polymer fibers 160.

Figure 10B:
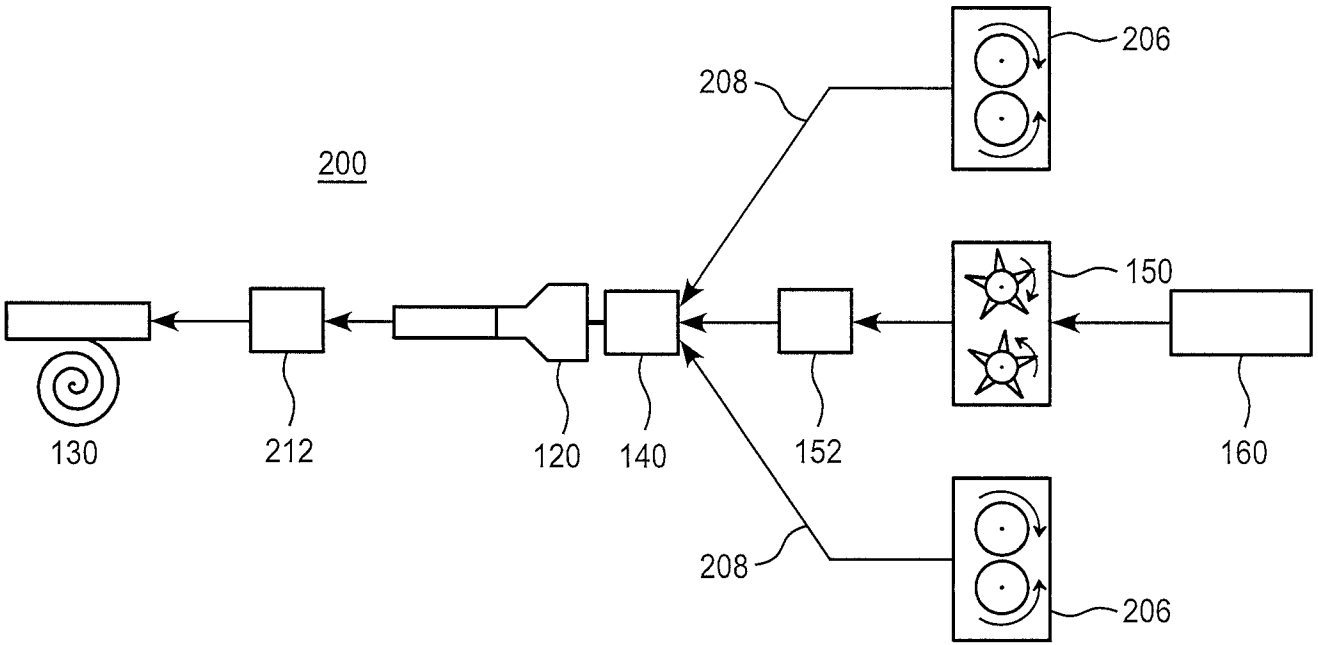
FIG. 10B shows a diagram of another embodiment of an apparatus for manufacturing a filter of a lofty porous network of charge retaining polymer fibers, in which the apparatus includes an optional slitter unit, tow band, tow band delivery rollers, flavoring and flavoring unit.
Figure 10C:
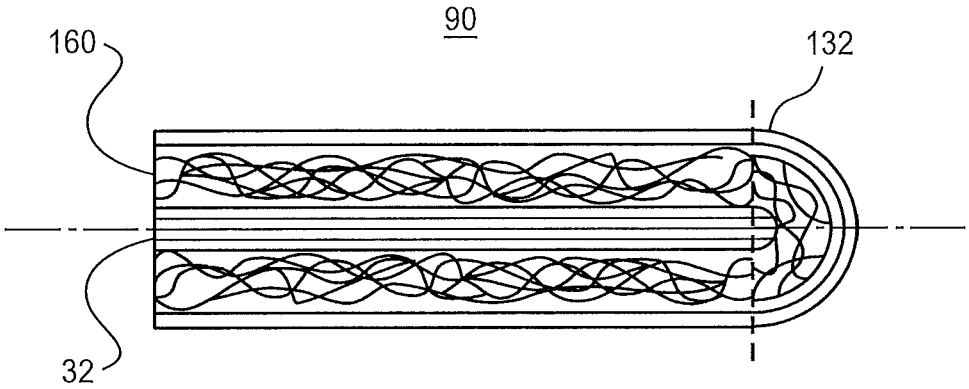
FIG. 10C illustrates an embodiment of a centric core filter including charge retaining polymer fibers in a lofty porous network outside a tow filter.

FIG. 10B shows another embodiment of the rod forming apparatus 200 including additional tow band delivery rollers 206 and optional flavoring unit 212. In the embodiment shown in FIG. 10B, an optional flavor can be incorporated in the continuous woven or non-woven lofty porous network of charge retaining polymer fibers 160 with or without the mediating filter fibers 202 (FIG. 10A) slit into desired width in a slitting unit 152 to replace tow bands 208 in the filter rod-forming unit 200 or formed into a filter rod without tow bands 208. A flavoring unit 212 can incorporate a liquid or solid flavorant 210 in the filter rod.

It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

We claim:

1. A method of making a filter assembly for a smoking article, comprising:

forming one or more fibers of charge retaining polymer into a lofty porous network;

surrounding the lofty porous network with a filter wrap;

charging the one or more fibers of charge retaining polymer;

slitting the lofty porous network into a width; and replacing a tow band in a filter rod forming unit with the lofty porous network of the width.

2. A method of making a filter assembly for a smoking article, comprising:

forming one or more fibers of charge retaining polymer into a lofty porous network;

surrounding the lofty porous network with a filter wrap to form a filter rod;

charging the one or more fibers of charge retaining polymer;

pre-forming the filter wrap into a cylindrical tube;

pulling the porous network into the preformed cylindrical tube to fill the pre-formed tube with porous network;

arranging the lofty porous network downstream of a sorbent including smoke entrainable sorbent particles in the filter wrap to form a composite filter; and cutting the filled preformed cylindrical tube to a predetermined length.

3. The method of making a filter assembly for a smoking article of claim 2, wherein pulling the porous network into the preformed cylindrical tube comprises:

threading a tool through the cylindrical tube;

hooking the lofty porous network with the tool; and drawing the tool through the cylindrical tube moving the lofty porous network into the cylindrical tube filling the cylindrical tube with the lofty porous network; and detaching the tool.

4. A method of making a filter assembly for a smoking article, comprising:

forming one or more fibers of charge retaining polymer into a lofty porous network;

surrounding the lofty porous network with a filter wrap to form a filter rod; and charging the one or more fibers of charge retaining polymer, wherein the method further comprises:

(a) cutting the filter rod into lengths before charging the one or more fibers of charge retaining polymer;

(b) cutting the filter rod into lengths and attaching each cut filter rod to a tobacco rod before charging the one or more fibers of charge retaining polymer;

(c) cutting the filter rod into lengths and joining each cut filter rod with at least one other filter section before charging the one or more fibers of charge retaining polymer; or (d) cutting the filter rod into lengths, joining each cut filter rod with at least one other filter section and attaching each joined filter rod to a tobacco rod before charging the one or more fibers of charge retaining polymer.

5. The method of making a filter assembly for a smoking article of claim 4, further comprising arranging the lofty porous network downstream of a sorbent including smoke entrainable sorbent particles in a filter wrap to form a composite filter.

6. The method of making a filter assembly for a smoking article of claim 4, wherein the charge retaining polymer comprises a polymer selected from the group consisting of a polyethylene, polypropylene, polyvinylidene difluoride, polytetrafluoroethylene, nylon, polyester, polyamide and combinations thereof.

7. The method of making a filter assembly for a smoking article of claim 4, wherein the charging of the one or more fibers of charge retaining polymer comprises at least one of:

(a) charging a batch of charge retaining polymer fibers;

(b) charging a continuous fiber of charge retaining polymer;

(c) charging after forming the one or more fibers into the lofty porous network;

(d) charging after surrounding the lofty porous network with the filter wrap.

8. The method of making a filter assembly for a smoking article of claim 7, wherein the surrounding of the lofty porous network with a filter wrap comprises shaping the network into a tubular structure, wrapping the tubular structure with the filter wrap, wherein a trailing end of the filter wrap overlaps a leading edge of the filter wrap wrapped on the tubular structure, and applying a strip of adhesive where the filter wrap overlaps upon itself.

9. The method of making a filter assembly for a smoking article of claim 4, wherein the charging of the one or more fibers of charge retaining polymer comprises one selected from the group consisting of: tribo-electrification charging, corona charging, electron beam charging, ion beam charging, radiation charging, boundary charging and combinations thereof.

10. The method of making a filter assembly for a smoking article of claim 4, wherein the forming the one or more fibers of charge retaining polymer into a lofty porous network comprises at least one of:

(a) gathering the one or more fibers in a bundle of randomly oriented fibers;

(b) gathering the one or more fibers in a bundle of randomly oriented fibers and one of mechanically bonding, needle punching, hydroentangling, chemically bonding, bonding with adhesives, bonding with latex resin, bonding with hot melt adhesive, thermally bonding, partial melt bonding of fibers, bonding on a heated calender roll, bonding newly formed fibers while still hot and a combination thereof to form the lofty porous network;

(c) gathering the fibers in a bundle of axially oriented fibers;

(d) adding mediating filter fibers;

(e) adding mediating filter fibers which are woven or non-woven fibers of polyester, cellulose acetate or a combination thereof;

(f) adding mediating filter fibers wherein the lofty porous network comprises one of a continuous woven media, a continuous non-woven media, and a combination thereof;

(g) crimping to form a charge retaining tow band of the lofty porous network.

11. The method of making a filter assembly for a smoking article of claim 4, wherein the lofty porous network comprises one of a continuous woven media, a continuous non-woven media, and a combination thereof.

12. The method of making a filter assembly for a smoking article of claim 4, further comprising:

cutting the lofty porous network into cylindrical segments; and supplying the segments of lofty porous network to a cigarette filter combiner unit, the cylindrical segments of porous network to serve as sections in a cigarette filter.

13. The method of making a filter assembly for a smoking article of claim 4, wherein the surrounding of the lofty porous network with the filter wrap comprises wrapping the lofty porous network with the filter wrap to form the filter rod.

14. A method of making a filter assembly for a smoking article, comprising:

forming one or more fibers of charge retaining polymer into a lofty porous network;

surrounding the lofty porous network with a filter wrap to form a filter rod;

charging the one or more fibers of charge retaining polymer;

placing 2-up plugs of filter material in spaced apart relationship to form a 4-up filter assembly;

placing plugs including the lofty porous network between the 2-up plugs such that cavities are formed at upstream and downstream ends of every other 2-up plug;

placing a sorbent including smoke entrainable sorbent particles in the cavities; and cutting the 4-up filter assembly centrally to form 2-up filter assemblies.

15. The method of claim 14, further comprising attaching a tobacco rod to each end of the 2-up filter assemblies to make a smoking article.

16. The method of claim 15, further including cutting said 2-up filter assemblies centrally to form complete cigarettes.

* * * * *